US006322458B1

(12) United States Patent
Kusumoto et al.

(10) Patent No.: US 6,322,458 B1
(45) **Date of Patent: *Nov. 27, 2001**

(54) GOLF CLUB SHAFT

(75) Inventors: Harunobu Kusumoto, Saitama; Satoshi Saitoh; Atsushi Matsuo, both of Tokyo, all of (JP)

(73) Assignee: Daiwa Seiko, Inc., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/959,979

(22) Filed: Oct. 29, 1997

(30) Foreign Application Priority Data

Oct. 30, 1996 (JP) ..... 8-288398

(51) Int. Cl.[7] ..... A63B 53/10
(52) U.S. Cl. ..... 473/316; 473/319
(58) Field of Search ..... 473/316–323

(56) References Cited

U.S. PATENT DOCUMENTS 5,551,691 * 9/1996 Harada ..... 473/318
5,681,226 * 10/1997 Chambers ..... 473/316

FOREIGN PATENT DOCUMENTS 7-213658 8/1995 (JP) .

* cited by examiner

*Primary Examiner*—Jeanette Chapman
*Assistant Examiner*—Stephen L. Blau
(74) *Attorney, Agent, or Firm*—Liniak, Berenato, Longacre & White

(57) ABSTRACT

A golf club shaft is constructed by a pipe-shaped body in which a sheet of reinforced fiber prepreg impregnated with synthetic resin is rolled. The golf club shaft includes: a front end portion to which a club head is attached; and a grip portion arranged on the opposite side to the front end portion, wherein a portion, the flexural rigidity of which is the maximum, is arranged on the front end portion side of the grip portion of the pipe-shaped body. The golf club shaft has a characteristic by which user's requirement can be satisfied.

1 Claim, 6 Drawing Sheets

GOLF CLUB SHAFT

BACKGROUND OF THE INVENTION

The present invention relates to a golf club shaft.

In the conventional golf club shaft, the flexural rigidity is gradually increased from the front end portion to the grip portion of the shaft, so that the flexural rigidity of the shaft end on the user's side becomes the maximum, that is, the flexural rigidity of the rear end of the grip portion becomes the maximum. According to the golf club shaft constructed as described above, it is impossible to provide a desired flexibility by which the user can be satisfied.

In order to improve the above disadvantages, Japanese Unexamined Patent Publication No. 7-213658 discloses a golf club shaft having a portion, the flexural rigidity of which is very low. However, in the above golf club shaft, the flexural rigidity of one portion of the shaft is simply reduced, and no consideration is given to the flexural rigidity of the entire shaft. Therefore, it is impossible to satisfy various requirements of the user such as a handling property, handling stability, directional stability and soft ball hitting feeling.

SUMMARY OF THE INVENTION

The present invention has been accomplished in view of the above circumstances. It is an object of the present invention to provide a golf club shaft having a characteristic by which various user's requirements can be satisfied.

The first aspect of the present invention is to provide a golf club shaft constructed by a pipe-shaped body in which a sheet of reinforced fiber prepreg impregnated with synthetic resin is rolled, comprising: a front end portion to which a club head is attached; and a grip portion arranged on the opposite side to the front end portion, wherein a portion, the flexural rigidity of which is the maximum, is arranged in the pipe-shaped body on the front end portion side of the grip portion.

The second aspect of the present invention is to provide a golf club shaft constructed by a pipe-shaped body in which a sheet of reinforced fiber prepreg impregnated with synthetic resin is rolled, comprising: a front end portion to which a club head is attached; and a grip portion arranged on the opposite side to the front end portion, wherein a first inflection point is formed in the pipe-shaped body, at which the flexural rigidity of the pipe-shaped body is changed from the positive to the negative when it comes from the front end portion side to the grip portion side, a second inflection point is formed in the pipe-shaped body, at which the flexural rigidity of the pipe-shaped body is changed from the negative to the positive when it comes from the front end portion side to the grip portion side, and the flexural rigidity at the first inflection point is higher than the flexural rigidity at the second inflection point.

The third aspect of the present invention is to provide a golf club shaft constructed by a pipe-shaped body in which a sheet of reinforced fiber prepreg impregnated with synthetic resin is rolled, comprising: a front end portion to which a club head is attached; and a grip portion arranged on the opposite side to the front end portion, wherein a portion, the flexural rigidity of which is changed sharply, is arranged in the pipe-shaped body on the front end portion side of the grip portion, and the maximum flexural rigidity at the portion, the flexural rigidity of which is changed sharply, is approximate to the flexural rigidity of the grip portion.

The fourth aspect of the present invention is to provide a golf club shaft constructed by a pipe-shaped body in which a sheet of reinforced fiber prepreg impregnated with synthetic resin is rolled, comprising: a front end portion to which a club head is attached; and a grip portion arranged on the opposite side to the front end portion, wherein a distribution of the flexural rigidity of the pipe-shaped body includes at least three inflection points at which a ratio of change in the flexural rigidity from the front end portion side is decreased and a ratio of change in the flexural rigidity from the front end potion side is increased.

The fifth aspect of the present invention is to provide a golf club shaft constructed by a pipe-shaped body in which a sheet of reinforced fiber prepreg impregnated with synthetic resin is rolled, comprising: a front end portion to which a club head is attached; and a grip portion arranged on the opposite side to the front end portion, wherein the crush rigidity of the pipe-shaped body from the front end portion to the grip portion is substantially constant, and the crush rigidity of the grip portion is increased toward the grip end portion.

The sixth aspect of the present invention is to provide a golf club shaft constructed by a pipe-shaped body in which a sheet of reinforced fiber prepreg impregnated with synthetic resin is rolled, comprising: a front end portion to which a club head is attached; and a grip portion arranged on the opposite side to the front end portion, wherein a region in which the flexural rigidity is decreased from the front end portion to the grip portion is formed in the front end portion of the pipe-shaped body, a region in which the flexural rigidity is sharply increased is formed between the front end portion and the grip portion, and the flexural rigidity in the grip portion is substantially constant.

The seventh aspect of the present invention is to provide a golf club shaft constructed by a pipe-shaped body in which a sheet of reinforced fiber prepreg impregnated with synthetic resin is rolled, comprising: a front end portion to which a club head is attached; and a grip portion arranged on the opposite side to the front end portion, wherein a region in which the flexural rigidity is gradually increased from the front end portion to the grip portion is formed between the front end portion and the grip portion of the pipe-shaped body, and a region in which the flexural rigidity is sharply increased from the front end portion to the grip portion is formed between the front end portion and the grip portion.

The eighth aspect of the present invention is to provide a golf club shaft constructed by a pipe-shaped body in which a sheet of reinforced fiber prepreg impregnated with synthetic resin is rolled, comprising: a front end portion to which a club head is attached; and a grip portion arranged on the opposite side to the front end portion, wherein a ratio $EI_{MAX}/EI_{MIN}$ of the maximum flexural rigidity $EI_{MAX}$ to the minimum flexural rigidity $EI_{MIN}$ of the pipe-shaped body is not lower than 4, a portion corresponding to the minimum flexural rigidity $EI_{MIN}$ is located on the front end portion side, and a portion corresponding to the maximum flexural rigidity $EI_{MAX}$ is located on the grip portion side.

The ninth aspect of the present invention is to provide a golf club shaft constructed by a pipe-shaped body in which a sheet of reinforced fiber prepreg impregnated with synthetic resin is rolled, comprising: a front end portion to which a club head is attached; and a grip portion arranged on the opposite side to the front end portion, wherein the torsional rigidity in a portion between the front end portion and the middle of the shaft is decreased from the front end portion to the middle of the shaft.

DETAILED DESCRIPTION OF THE PREFERRED EMBODIMENTS

Referring to the accompanying drawings, embodiments of the present invention will be specifically explained below.

The present inventors made investigation into the distributions of flexural rigidity, crush rigidity and torsional rigidity of the entire golf club shaft. As a result of the investigation, various user's requirements were satisfied by the golf club shaft of the present invention as follows.

[FIRST EMBODIMENT]

This embodiment corresponds to the first aspect of the present invention. In this embodiment, it is possible to provide a golf club shaft constructed by a pipe-shaped body in which a sheet of reinforced fiber prepreg impregnated with synthetic resin is rolled, comprising: a front end portion to which a club head is attached; and a grip portion arranged on the opposite side to the front end portion, wherein a portion, the flexural rigidity of which is the maximum, is arranged in the pipe-shaped body on the front end portion side of the grip portion.

Figure 1:
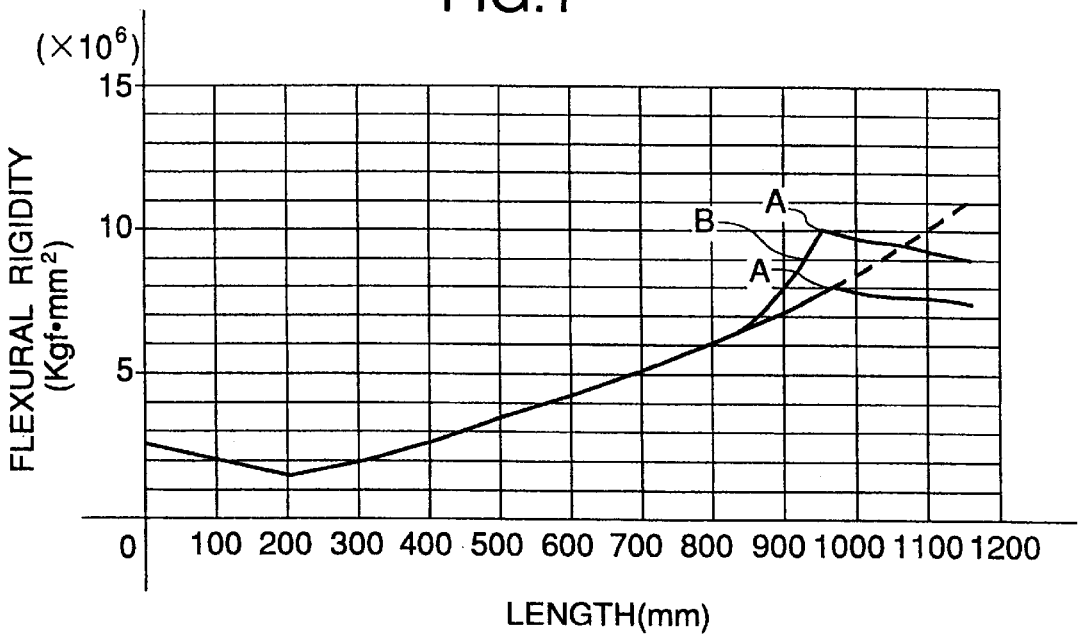
FIG. 1 is a diagram showing a distribution of flexural rigidity of the golf club shaft of the first embodiment of the present invention.

As shown in FIG. 1, in this embodiment, it is preferable that a portion A, the flexural rigidity of which becomes the maximum, is set in a range of 200 to 400 mm from the grip end portion of the pipe-shaped body when consideration is given to the length of the grip of both hands of a user and also when consideration is given to a user who holds the grip portion in his hands while the grip end is left in such a manner that a portion of the grip end is not held in his hands. In this case, the distribution of the flexural rigidity is set in such a manner that the flexural rigidity is decreased from the portion A in which the flexural rigidity becomes the maximum, to the grip end portion and that the flexural rigidity becomes the minimum in grip end portion.

The maximum flexural rigidity is set at a value not lower than 5% of the flexural rigidity of the grip end portion, and it is preferable that the maximum flexural rigidity is set at a value not lower than 10% of the flexural rigidity of the grip end portion. It is preferable that the flexural rigidity of the grip end portion is 50 to 90% of the maximum flexural rigidity. For example, in the case of a wood club of common use, the maximum flexural rigidity is approximately $7.5\times10^6$ to $10.0\times10^6$ kgf·mm2, and the flexural rigidity of the grip end portion is approximately $5.5\times10^6$ to $7.0\times10^6$ kgf·mm2.

In order to enhance the maximum flexural rigidity, on the front end side of the portion A in which the flexural rigidity becomes the maximum, that is, in a range of 100 to 200 mm from the portion A, a region B in which the flexural rigidity is increased at a high rate of change may be provided. In this connection, a ratio of change in the flexural rigidity is not lower than 1.3 per 100 mm. It is preferable that a ratio of change in the flexural rigidity is approximately 1.5.

According to the above structure, when a user swings this golf club shaft, it is possible for him to have a very firm feeling in a portion of the shaft located on the front side in the vicinity of his hand holding the grip, that is, in the case of a right-handed user, it is possible for him to have a very firm feeling in a portion of the shaft located on the front side in the vicinity of his right hand holding the grip. This portion of the shaft located on the front side in the vicinity of the user's hand holding the grip will be referred to as a front side vicinity in this specification hereinafter.

To be more specific, when the user swings the golf club shaft, a high intensity of bending moment is generated in the front side vicinity of his hand holding the grip, that is, in the case of a right-handed user, a high intensity of bending moment is generated in the front side vicinity of his right hand. When the flexural rigidity of the shaft in this portion is insufficient, it is impossible for the user to have a firm feeling. The present inventors made investigation into this feeling of firmness in earnest. As a result of the investigation, they found the following. The feeling of firmness in this portion is affected by not only the flexural rigidity in this portion but also the flexural rigidity in the intermediate portion between both hands holding the grip portion. This intermediate portion between both hands holding the grip portion will be referred to as an intermediate portion in this specification hereinafter. That is, by a relative difference between the flexural rigidity in the front side vicinity and the flexural rigidity in this intermediate portion, the user has a feeling of firmness. In other words, when the flexural rigidity in the front side vicinity is higher than the flexural rigidity in the intermediate portion, the user feels that the flexural rigidity in the front side vicinity is high.

In the conventional golf club shaft, the following problems may be encountered. In order to provide a feeling of firmness of the shaft, the flexural rigidity of the end portion of the shaft is unnecessarily increased. Therefore, the shaft becomes hard unnecessarily. In this embodiment, the above conventional problems have been solved.

In order for the user to have a feeling of bend of the golf club shaft although he has no feeling of a change in the shape of the shaft, it is preferable that the crush rigidity of the shaft in the grip portion is high, that is, it is preferable that the hardness is set so that the shape of the grip can not be changed when he holds the grip.

[SECOND EMBODIMENT]

This embodiment corresponds to the second aspect of the present invention. In this embodiment, it is possible to provide a golf club shaft constructed by a pipe-shaped body in which a sheet of reinforced fiber prepreg impregnated with synthetic resin is rolled, comprising: a front end portion to which a club head is attached; and a grip portion arranged on the opposite side to the front end portion, wherein a first inflection point is formed in the pipe-shaped body, at which the flexural rigidity of the pipe-shaped body is changed from the positive to the negative when it comes from the front end portion side to the grip portion side, a second inflection point is formed in the pipe-shaped body, at which the flexural rigidity of the pipe-shaped body is changed from the negative to the positive when it comes from the front end portion side to the grip portion side, and the flexural rigidity at the first inflection point is higher than the flexural rigidity at the second inflection point.

Figure 2:
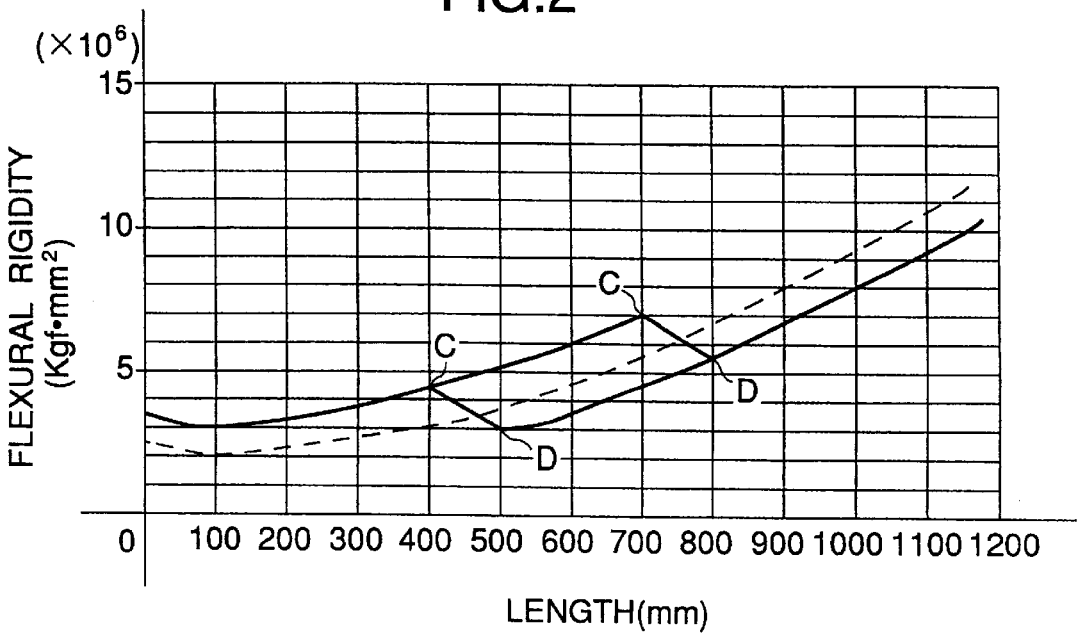
FIG. 2 is a diagram showing a distribution of flexural rigidity of the golf club shaft of the second embodiment of the present invention.

In this embodiment, there are provided two inflection points on the distribution curve of the flexural rigidity shown in FIG. 2. Due to the foregoing, in a range of about ⅓ of the entire length of the shaft on the front side, the flexural rigidity can be set relatively high, for example, the flexural rigidity can be set at 3 to $6\times10^6$ kgf·mm2. Specifically, the distribution of the flexural rigidity of the shaft is set as follows. In a range of 400 to 700 mm from the front end of the shaft, the flexural rigidity of the shaft is gradually increased; in a range of about 100 mm from the first inflection point, the flexural rigidity of the shaft is gradually decreased; and in a range from the inflection point D to the base of the shaft, the flexural rigidity is gradually increased. In this case, a difference between the flexural rigidity at the first inflection point C and the flexural rigidity at the second inflection point D is set at a value not lower than $1\times10^6$ kgf·mm$^2$ while consideration is given to the easiness of having a feeling of the bend (kick point) of the shaft. It is preferable that a difference between the flexural rigidity at the first inflection point C and the flexural rigidity at the second inflection point D is set at a value not lower than $2\times10^6$ kgf·mm$^2$.

In the golf club in which the above golf club shaft is used, the flexural rigidity is relatively high in the front end portion of the shaft, and the length of a region in which the flexural rigidity is low is relatively long between the front end and the base of the shaft. Therefore, a quantity of bend of the entire shaft can be made to be approximate to that of the conventional club. Accordingly, it is possible to reduce a sense of incongruity (difference between the feeling obtained by this shaft and the feeling obtained by the conventional shaft) when the user swings this golf club shaft. For example, when the kick point is located in a portion where the flexural rigidity is low, it becomes possible to extend the length of a region where the flexural rigidity is low as shown by the lower curve in FIG. 2. Accordingly, it possible to emphasize the kick point, and the user can easily perceive a state of bend of the shaft.

Since the flexural rigidity gradually changes when it comes from the front end to the base of the shaft, it is possible to prevent a local decrease in the mechanical strength of the shaft. Therefore, the mechanical strength can be stably enhanced. Since the flexural rigidity in the front end portion of the shaft is relatively high, it is possible to suppress the occurrence of a local bend in the front end portion when the user swings the shaft. Accordingly, deviation of the direction of a golf ball which has been hit by this golf club can be prevented. Further, it is possible to reduce a change in the loft angle of the golf club when a golf ball is hit by this golf club. Accordingly, a trajectory of the golf ball can be stabilized.

[THIRD EMBODIMENT]

This embodiment corresponds to the third aspect of the present invention. In this embodiment, it is possible to provide a golf club shaft constructed by a pipe-shaped body in which a sheet of reinforced fiber prepreg impregnated with synthetic resin is rolled, comprising: a front end portion to which a club head is attached; and a grip portion arranged on the opposite side to the front end portion, wherein a portion, the flexural rigidity of which is changed sharply, is arranged in the pipe-shaped body on the front end portion side of the grip portion, and the maximum flexural rigidity at the portion, the flexural rigidity of which is changed sharply, is approximate to the flexural rigidity of the grip portion.

Figure 3:
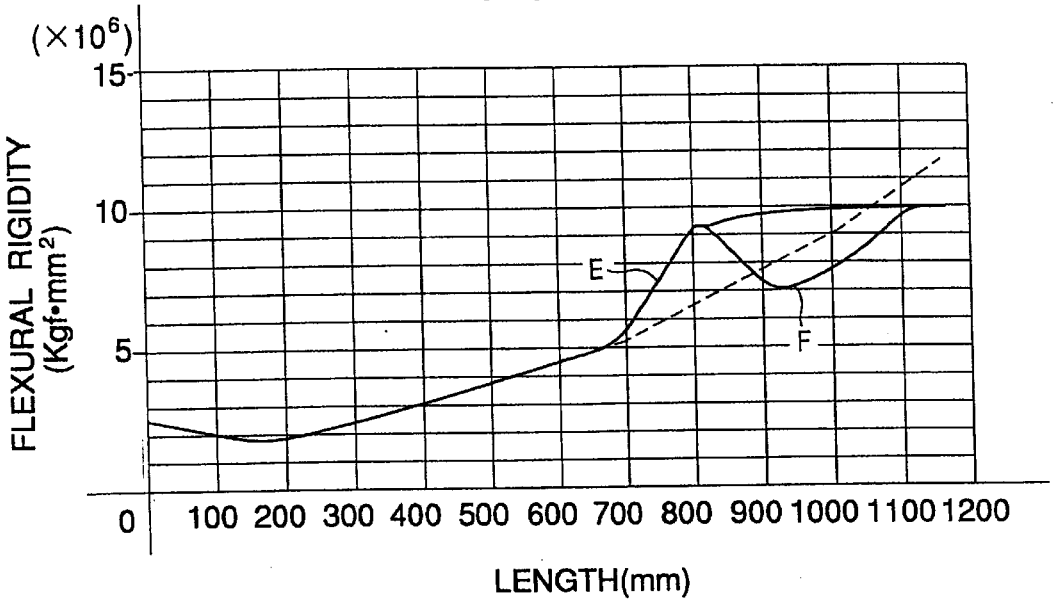
FIG. 3 is a diagram showing a distribution of flexural rigidity of the golf club shaft of the third embodiment of the present invention.

As shown in FIG. 3, in this embodiment, it is preferable that the portion E, the flexural rigidity of which is changed sharply, is located at a position distant from the grip portion to the front end side of the shaft by 200 mm so that a shock caused when a golf ball is hit can be absorbed. In this case, the portion E, the flexural rigidity of which is changed sharply, is defined as a portion in which a ratio of change in the flexural rigidity is 1.5 to 2.0 with respect to the length 100 mm of the shaft.

In this embodiment, the maximum flexural rigidity in the portion, the flexural rigidity of which is changed sharply, is approximate to the flexural rigidity of the grip portion. The above means that a difference between the maximum flexural rigidity in the portion, the flexural rigidity of which is changed sharply, and the flexural rigidity in the grip portion is not more than $1\times10^6$ kgf·mm$^2$.

When consideration is given to a feeling of rigidity (feeling of perceiving the rigidity of the shaft), it is preferable that the flexural rigidity of the shaft from the portion, the flexural rigidity of which is changed sharply, to the grip end portion is constant or increased gradually toward the grip end portion. In this connection, when necessary, in a range from the portion on the side of the shaft base, the flexural rigidity of which is changed sharply, to the grip end portion, it is possible to provide a low rigidity portion F, the flexural rigidity of which is lower than the maximum flexural rigidity of the flexural rigidity sharply changing portion by $2\times10^6$ kgf·mm$^2$. It is preferable that the maximum flexural rigidity in the flexural rigidity sharply changing portion is higher than the flexural rigidity (for example, $6.7\times10^6$ kgf·mm$^2$) of the same position of the conventional shaft, the flexural rigidity of which is gradually increased from the front end to the base of the shaft by $2\times10^6$ kgf·mm$^2$.

Mechanical strength of the golf club is very high, in which the above golf club shaft is used, and the user has a feeling of firmness when he uses the golf club. Further, the above golf club shaft can be greatly bent in a portion between the intermediate portion of the shaft and the front end portion. Due to the foregoing, when the user swings the golf club, it is possible for him to have a feeling of hardness, and further the golf club shaft can be bent more than the feeling of the user. Therefore, a golf ball can be hit high by this golf club.

[FOURTH EMBODIMENT]

This embodiment corresponds to the fourth aspect of the present invention. In this embodiment, it is possible to provide a golf club shaft constructed by a pipe-shaped body in which a sheet of reinforced fiber prepreg impregnated with synthetic resin is rolled, comprising: a front end portion to which a club head is attached; and a grip portion arranged on the opposite side to the front end portion, wherein a distribution of the flexural rigidity of the pipe-shaped body includes at least three inflection points at which a change in the flexural rigidity from the front end side is changed from the positive to the negative and a change in the flexural rigidity from the front end side is changed from the negative to the positive.

Figure 4:
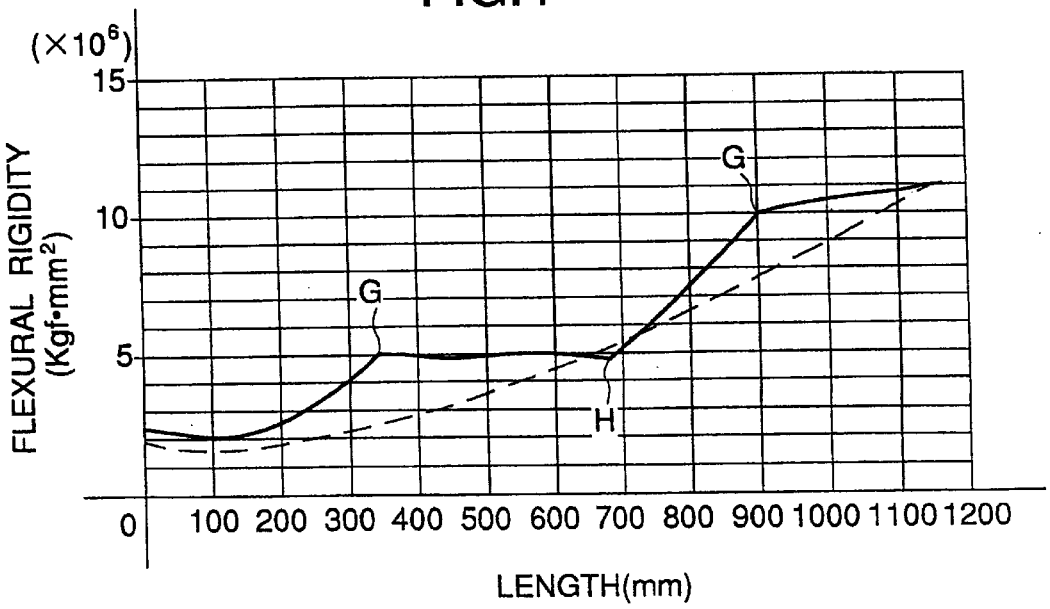
FIG. 4 is a diagram showing a distribution of flexural rigidity of the golf club shaft of the fourth embodiment of the present invention.

In this embodiment, as shown in FIG. 4, it is preferable that the inflection points are set in the order of: the inflection point G at which a ratio of change in the flexural rigidity from the front end of the shaft is decreased; the inflection point H at which a ratio of change in the flexural rigidity from the front end of the shaft is increased; and the inflection point G at which a ratio of change in the flexural rigidity from the front end of the shaft is decreased.

In the case where three inclination points are provided as shown in FIG. 4, it is preferable that the length from the front end of the shaft to the first inclination point is 20 to 50% of the entire length of the shaft (for example, 250 to 570 mm from the front end portion of the shaft), and it is also preferable that the length from the front end of the shaft to the second inclination point is 40 to 70% of the entire length of the shaft (for example, 450 to 800 mm from the front end portion of the shaft). For example, the length from the first inclination point G to the second inclination point H is not less than 200 mm, and it is preferable that the length from the first inclination point G to the second inclination point H is 300 to 600 mm. The length from the second inclination point H to the third inclination point G is 50 to 300 mm, and it is preferable that the length from the second inclination point H to the third inclination point G is not less than 100 mm. In this connection, the length between the inclination points is appropriately determined according to the number of inclination points and the ratio of change in the flexural rigidity. For example, the length between the inclination points may be determined to be 20 to 150 mm, so that the number of inclination points can be increased, or alternatively the positions of inclination points may be concentrated to the center of the shaft. Further, the number of inclination points may be increased, for example, the number of the inclination points G at which a ratio of change in the flexural rigidity from the front end of the shaft is decreased may be determined to be three, and the number of the inclination points H at which a ratio of change in the flexural rigidity from the front end of the shaft is increased may be determined to be two.

In the region from the front end of the shaft to the inclination point G at which the ratio of change in the flexural rigidity is decreased, in order to prevent a deformation of the front end portion of the shaft so as to stabilize the trajectory of a golf ball after it has been hit by the golf club shaft, the ratio of change in the flexural rigidity may be increased by 1.2 to 1.5 times per 100 mm so that the flexural rigidity can be increased sharply. In the region from the first inclination point G to the second inclination point H, in order to bend the shaft when the user swings it, the ratio of change in the flexural rigidity may be set at a substantially constant value, or alternatively the ratio of change in the flexural rigidity may be gradually increased or decreased toward the base of the shaft. For example, a difference of the flexural rigidity between the first inclination point G and the second inclination point H is $\pm 2\times 10^6$ kgf·mm2 of the flexural rigidity of the first inclination point G, and it is preferable that a difference of the flexural rigidity between the first inclination point G and the second inclination point H is $\pm 1\times 10^6$ kgf·mm2 of the flexural rigidity of the first inclination point G.

In the golf club in which the above golf club shaft is used, a portion (inclination point H) in which the flexural rigidity is low is bent easily. Therefore, the user can easily perceive a bend (kick point) of the golf club shaft without extremely lowering the flexural rigidity of the entire shaft. Due to the foregoing, the user can easily control the swing of the golf club.

[FIFTH EMBODIMENT]

This embodiment corresponds to the fifth aspect of the present invention. In this embodiment, it is possible to provide a golf club shaft constructed by a pipe-shaped body in which a sheet of reinforced fiber prepreg impregnated with synthetic resin is rolled, comprising: a front end portion to which a club head is attached; and a grip portion arranged on the opposite side to the front end portion, wherein the crush rigidity of the pipe-shaped body from the front end portion to the grip portion is substantially constant, and the crush rigidity of the grip portion is increased toward the grip end portion.

Figure 5:
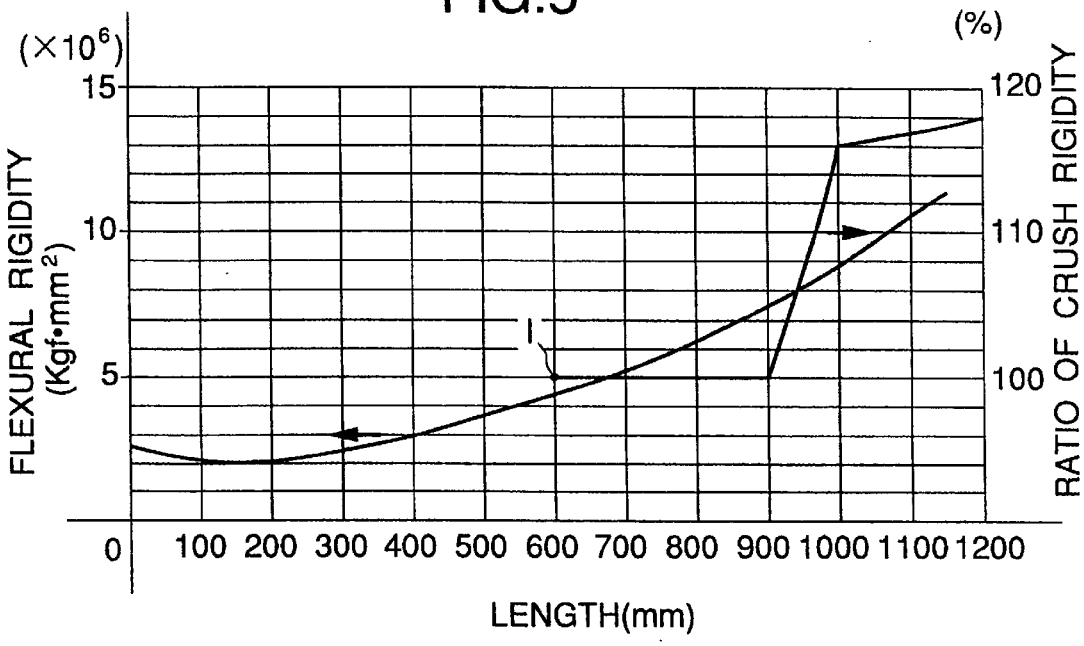
FIG. 5 is a diagram showing a distribution of flexural rigidity of the golf club shaft of the fifth embodiment of the present invention.

In this embodiment, the crush rigidity of the shaft is increased as follows. For example, the crush rigidity of the position I distant from the front end of the shaft by 600 mm in FIG. 5 is used as a reference (100%), and the crush rigidity of the shaft is sharply increased by not lower than 100% from the position distant from the front end of the shaft by 900 mm toward the base of the shaft. It is preferable that the crush rigidity of the shaft is sharply increased by 110 to 150%. In this embodiment, the crush rigidity is set in such a manner that the crush rigidity is increased by 116% at a position distant from the front end of the shaft by 900 to 1000 mm, and the crush rigidity is gradually increased in a region distant from the front end of the shaft by 1000 to 1200 mm. In this connection, the flexural rigidity is set in such a distribution that the flexural rigidity is increased from the front end of the shaft toward the base of the shaft.

Usually, the diameter of the shaft on the base side is large and the wall thickness of the shaft on the base side is small. Accordingly, the crush rigidity on the base side of the shaft is decreased. Therefore, it is necessary that the flexural rigidity of the shaft on the base side is extremely increased. However, when the crush rigidity is distributed as described above, it becomes unnecessary that the flexural rigidity on the base side of the shaft is extremely increased, and the bend of the entire shaft including the grip portion can be effectively utilized, and even when the user holds the grip strongly, he feels no sense of incongruity. Further, it is possible to prevent a crush of the base portion of the shaft and realize a golf club shaft of high mechanical strength. Furthermore, a portion of the shaft which becomes a fulcrum when the golfer holds the grip portion, that is, a portion of the shaft held by the left hand of a right-handed user has a high crush rigidity. Therefore, the user can have a sense of holding the shaft firmly and swing the golf club stably.

Figure 10A:
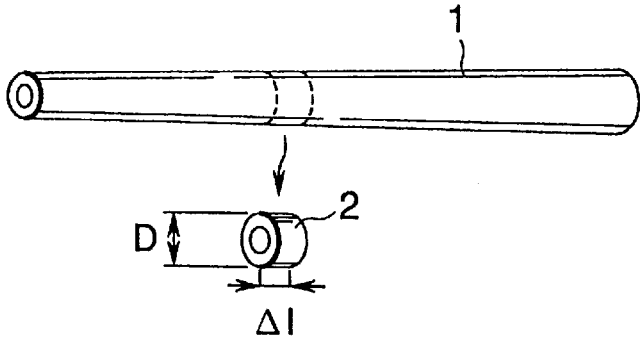
FIGS. 10(A) to 10(C) are schematic illustrations for explaining the crush rigidity of the golf club shaft of the fifth embodiment of the present invention.
Figure 10B:
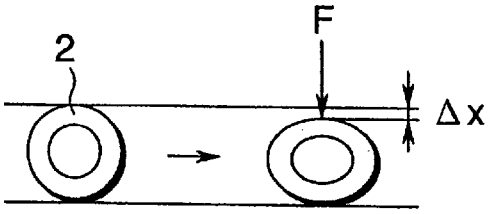
Figure 10C:
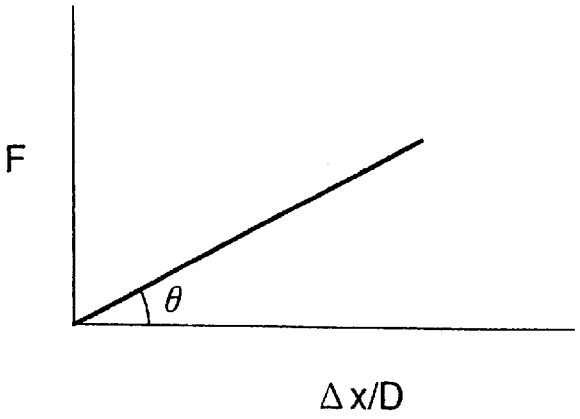

In this connection, the crush rigidity in this embodiment is defined as a rigidity in the case of applying a load F to a pipe-shaped body of diameter D. As shown in FIG. 10(A), there is provided a short pipe-shaped body 2 of the golf club shaft 1, the outer diameter of which is D, and the minute length of which is _1. As shown in FIG. 10(B), when a load F is given to this pipe-shaped body 2, the pipe-shaped body 2 is deformed by a quantity of deformation _x. In this case, a relation between the load F and the ratio of the crush deformation _x to the outer diameter D is shown on FIG. 10(C). As shown in FIG. 10(C), it is possible to obtain a relation expressed by the equation $\tan\theta = F/(_x/D)$. Accordingly, in this embodiment, this value is made to be approximate to a value of crush rigidity.

[SIXTH EMBODIMENT]

This embodiment corresponds to the sixth aspect of the present invention. In this embodiment, it is possible to provide a golf club shaft constructed by a pipe-shaped body in which a sheet of reinforced fiber prepreg impregnated with synthetic resin is rolled, comprising: a front end portion to which a club head is attached; and a grip portion arranged on the opposite side to the front end portion, wherein a region in which the flexural rigidity is decreased from the front end portion to the grip portion is formed in the front end portion of the pipe-shaped body, a region in which the flexural rigidity is sharply increased is formed between the front end portion and the grip portion, and the flexural rigidity in the grip portion is substantially constant.

Figure 6:
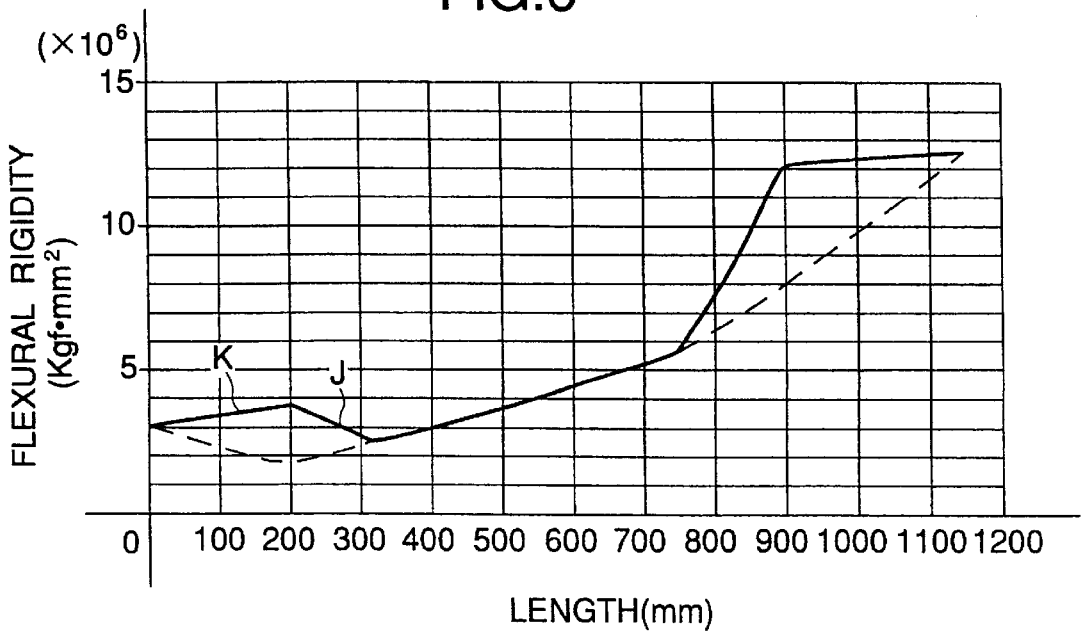
FIG. 6 is a diagram showing a distribution of flexural rigidity of the golf club shaft of the sixth embodiment of the present invention.

In this embodiment, as shown in FIG. 6, in the front end portion, there is provided a region J in which the flexural rigidity of the shaft is decreased from the front end portion to the grip portion. In order to form this region J, there is provided a region K in which the flexural rigidity of the shaft is increased from the front end portion of the shaft. The minimum flexural rigidity is exhibited in the region J on the base side of the shaft, that is, the minimum flexural rigidity is exhibited at a position distant from the front end of the shaft by 250 to 400 mm. In this connection, it is preferable that a difference between the maximum flexural rigidity in the region K and the minimum flexural rigidity in the region J is not lower than $1\times10^6$ kgf·mm$^2$ when consideration is given to a decrease in the quantity of deformation of the front end portion of the shaft.

In the golf club in which the above golf club shaft is used, when a golf ball is hit by this golf club, it is possible to adjust a bend of the shaft in a wide range, so that the loft angle and the face angle of the golf club can be prevented from changing sharply when the golf club is swung by a user. Accordingly, it is possible to stabilize a trajectory of the golf ball, and the occurrence of a hook ball or a slice ball can be decreased.

In this embodiment, there is provided a region in which the flexural rigidity of the shaft is sharply increased between the front end portion and the grip portion of the shaft. In order to reduce a shock caused when a golf ball is hit, this region is arranged at a position distant from the front end of the shaft by 750 to 900 mm. As shown in FIG. 6, the flexural rigidity of the shaft is increased to about 5–6$\times10^6$ kgf·mm2. It is preferable that the flexural rigidity of the shaft at this position is higher than the flexural rigidity of the conventional shaft at the same position by about $3\times10^6$ kgf·mm2. In order for the user to have a feeling of bend in the intermediate portion of the shaft, the flexural rigidity of the shaft in the grip portion is set to be substantially constant or gradually increase toward the base side of the shaft.

By the golf club in which the above golf club shaft is used, the user can hit a golf ball while he has a feeling of rigidity in his hands and at the same time he has a feeling of bend of the intermediate portion of the shaft, further it is possible for him to hit a ball, the trajectory of which is stable.

In this connection, concerning this embodiment, two embodiments may be used being combined with each other or alternatively independent from each other as shown in FIG. 6.

[SEVENTH EMBODIMENT]

This embodiment corresponds to the seventh aspect of the present invention. In this embodiment, it is possible to provide a golf club shaft constructed by a pipe-shaped body in which a sheet of reinforced fiber prepreg impregnated with synthetic resin is rolled, comprising: a front end portion to which a club head is attached; and a grip portion arranged on the opposite side to the front end portion, wherein a region in which the flexural rigidity is gradually increased from the front end portion to the grip portion is formed between the front end portion and the grip portion of the pipe-shaped body, and a region in which the flexural rigidity is sharply increased from the front end portion to the grip portion is formed between the front end portion and the grip portion.

Figure 7:
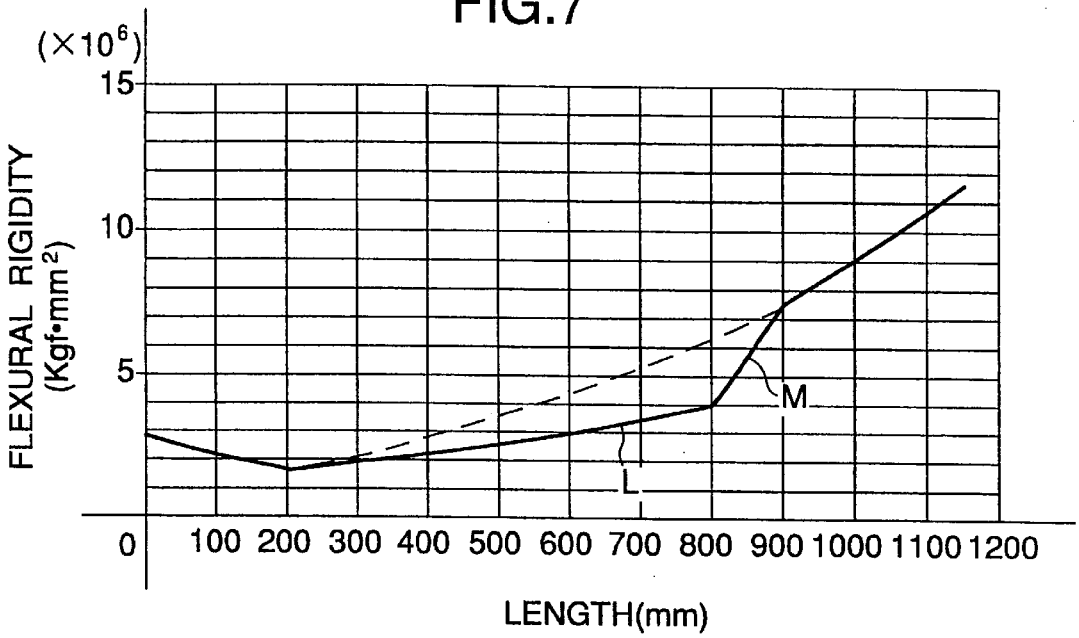
FIG. 7 is a diagram showing a distribution of flexural rigidity of the golf club shaft of the seventh embodiment of the present invention.

In this embodiment, as shown in FIG. 7, between the front end portion and the grip portion of the shaft, for example, in a range distant from the front end of the shaft by 400 to 800 mm, there is provided a region L in which the flexural rigidity of the shaft is gradually increased from the front end portion to the grip portion. When consideration is given to a bend of the entire shaft, it is preferable that a ratio of change in the flexural rigidity in the region L is not higher than $1\times10^6$ kgf·mm2/100 mm (in the case shown in FIG. 7, not higher than $0.5\times10^6$ kgf·mm2/100 mm).

There is provided a region M in which the flexural rigidity of the shaft is sharply increased from the front end portion to the grip portion, for example, there is provided a region M at a position distant from the front end of the shaft by about 800 mm. In the region M, in order to reduce a shock caused when a golf ball is hit or ensure a feeling of rigidity in the user's hand, it is preferable that a ratio of change in the flexural rigidity is set at a value not lower than $2\times10^6$ kgf·mm$^2$ in a range of not less than 50 mm, usually in a range from 100 to 200 mm.

In the golf club in which the above golf club shaft is used, the flexural rigidity of the grip portion is high. Therefore, it is possible for the user to have a feeling of stability when he swings this golf club. When this golf club is used, it is possible to obtain a sufficiently large bend on the front end side of the shaft compared with the grip portion including the intermediate portion of the shaft. Accordingly, even when a powerless person uses this golf club, he can swing it easily having a feeling of bend of the shaft. Also, he can hit a golf ball timely.

[EIGHTH EMBODIMENT]

This embodiment corresponds to the eighth aspect of the present invention. In this embodiment, it is possible to provide a golf club shaft constructed by a pipe-shaped body in which a sheet of reinforced fiber prepreg impregnated with synthetic resin is rolled, comprising: a front end portion to which a club head is attached; and a grip portion arranged on the opposite side to the front end portion, wherein a ratio $EI_{MAX}/EI_{MIN}$ of the maximum flexural rigidity $EI_{MAX}$ to the minimum flexural rigidity $EI_{MIN}$ of the pipe-shaped body is not lower than 4, a portion corresponding to the minimum flexural rigidity $EI_{MIN}$ is located on the front end portion side, and a portion corresponding to the maximum flexural rigidity $EI_{MAX}$ is located on the grip portion side.

Figure 8:
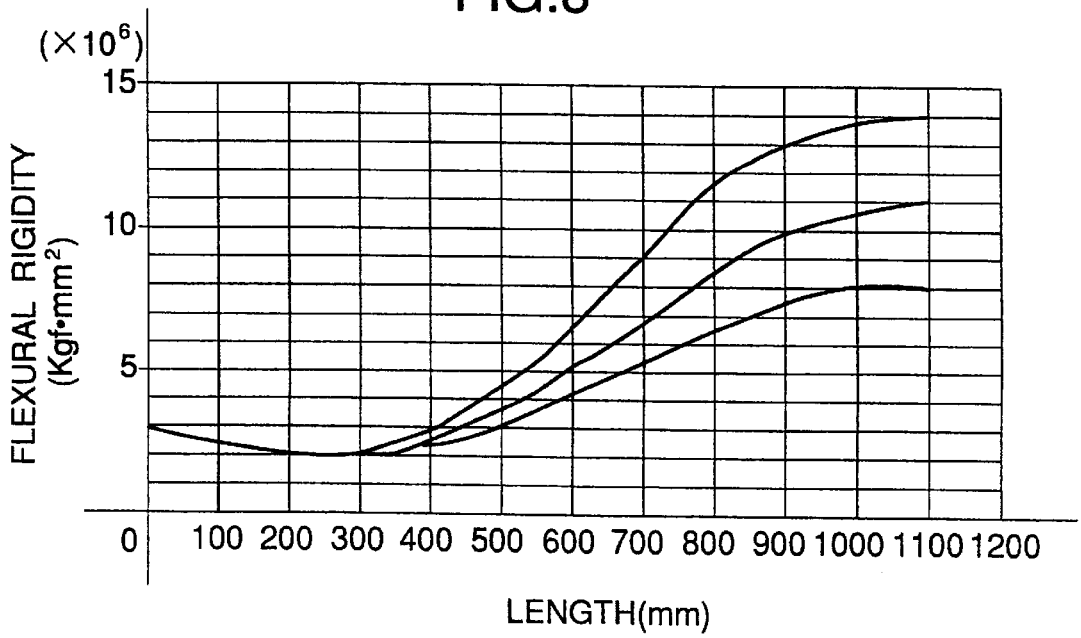
FIG. 8 is a diagram showing a distribution of flexural rigidity of the golf club shaft of the eighth embodiment of the present invention.

In this embodiment, a ratio $EI_{MAX}/EI_{MIN}$ of the maximum flexural rigidity $EI_{MAX}$ to the minimum flexural rigidity $EI_{MIN}$ of the pipe-shaped body is set at a value not lower than 4, and a ratio $EI_{MAX}/EI_{MIN}$ is preferably set at a value not lower than 5, and a ratio $EI_{MAX}/EI_{MIN}$ is more preferably set at a value not lower than 6. As shown in FIG. 8, the distribution curve of the flexural rigidity of the shaft of this embodiment is concave on the front end side and convex on the grip side.

When the above golf club shaft of this embodiment is compared with the conventional golf club shaft, the flexibility (hardness) of which is the same as that of the above golf club shaft of this embodiment, the flexural rigidity of the front end portion is low and the flexural rigidity on the grip end side is high. Accordingly, it is possible for the user to hit a golf ball while he has a feeling of rigidity in his hands and a shock caused when the golf ball is hit can be reduced, that is, the user has a soft feeling when he hits the ball. When this golf club shaft is used, the head of the golf club can be returned to the initial position easily when the user swings this golf club. Accordingly, the occurrence of a slice ball can be prevented.

In the case of the golf club shaft of this embodiment, the ratio $EI_{MAX}/EI_{MIN}$ of which is not lower than 4, the golf club shaft is suitable for a player whose golf club head speed is 35 to 40 m/sec. In the case of the golf club shaft of this embodiment, the ratio $EI_{MAX}/EI_{MIN}$ of which is not lower than 5, the golf club shaft is suitable for a player whose golf club head speed is 38 to 43 m/sec. In the case of the golf club shaft of this embodiment, the ratio $EI_{MAX}/EI_{MIN}$ of which is not lower than 6, the golf club shaft is suitable for a player whose golf club head speed is not lower than 43 m/sec.

[NINTH EMBODIMENT]

This embodiment corresponds to the ninth aspect of the present invention. In this embodiment, it is possible to provide a golf club shaft constructed by a pipe-shaped body in which a sheet of reinforced fiber prepreg impregnated with synthetic resin is rolled, comprising: a front end portion to which a club head is attached; and a grip portion arranged on the opposite side to the front end portion, wherein the torsional rigidity in a portion between the front end portion and the middle of the shaft is decreased from the front end portion to the middle of the shaft.

Figure 9:
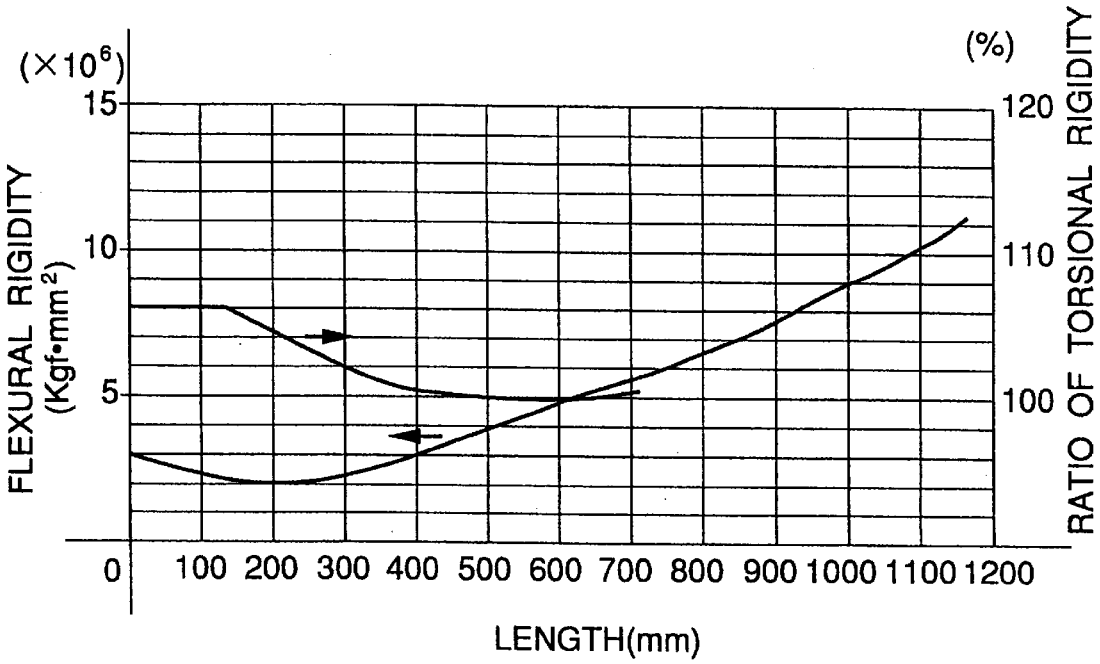
FIG. 9 is a diagram showing distributions of flexural rigidity and torsional rigidity of the golf club shaft of the ninth embodiment of the present invention.

In this embodiment, the torsional rigidity is set in such a manner that the torsional rigidity is decreased from the front end portion to the middle portion of the shaft. That is, as shown in FIG. 9, the torsional rigidity of the shaft is set as follows. When the torsional rigidity in the middle of the shaft is 100%, that is, when the torsional rigidity at the position distant from the front end of the shaft by 600 mm is 100%, the torsional rigidity at the front end portion of the shaft is set at about 110%, and the torsional rigidity of the shaft is decreased from the front end portion to the base portion of the shaft. The reason why the torsional rigidity of the shaft is set as described above is a reduction of a shock caused when a golf ball is hit by this golf club. In this connection, concerning the flexural rigidity, the distribution of flexural rigidity is set in such a manner that the flexural rigidity is increased from the front end of the shaft to the base portion of the shaft.

In this connection, in FIGS. 1 to 9, broken lines show the distribution of flexural rigidity of the conventional golf club shaft.

In the golf club in which the above golf club shaft is used, the torsional rigidity on the front end side is high. Therefore, the torsion in the front end portion of the shaft is small. Accordingly, even when a golf ball is hit by the golf club head out of the sweet spot, the torsion caused in the golf club head is small, and the golf ball can be raised high by a large angle, and further the direction of the golf ball hit by the golf club can be stabilized. Furthermore, the occurrence of a slice ball can be prevented.

When a club head is attached to the above pipe-shaped body by the common method, it is possible to obtain a golf club.

In the first to the ninth embodiment described above, a sheet of reinforced fiber prepreg is manufactured in such a manner that reinforced fibers are impregnated with synthetic resin. Examples of usable reinforced fibers are: carbon fibers, glass fibers, aluminum fibers, and aramid fibers. Examples of synthetic resins are: epoxy resin, phenol resin, and polyester.

In the first to the ninth embodiment, the front end portion is defined as a region distant from the end portion of the pipe-shaped body by 300 to 400 mm, and the grip portion is defined as a region distant from the end portion of the pipeshaped body by 200 to 300 mm.

In the first to the ninth embodiment, the distributions of flexural rigidity, torsional rigidity and crush rigidity in the pipe-shaped body can be realized by adjusting the shape of a rolled sheet of prepreg, the directions of fibers, the thickness, the quantity of impregnated synthetic resin and the elastic modulus of fibers.

In the first to the ninth embodiment, the length of the region in which the flexural rigidity is gradually changed, that is, the length of the inclined portion in FIGS. 1 to 9 is set to be 30 to 60 mm. It is preferable that the length of the inclined portion is not less than 100 mm. When the region in which the flexural rigidity is changed is set in a relatively long range in the longitudinal direction, it becomes easy to set a kick point, and the concentration of stress is prevented, so that the mechanical strength can be enhanced and stabilized.

In the first to the ninth embodiment, the explanation of a long shaft such as a driver's shaft or a spoon's shaft is given. However, it should be noted that the present invention can be applied to a short shaft such as a sand wedge's shaft or a pitching wedge's shaft, that is, the present invention can be applied to the shafts of all golf clubs. When the total length of the shaft is small, the distance from the front end of the shaft may be determined by a predetermined ratio of each embodiment. A position at which the flexural rigidity is changed can be found by the proportional calculation.

As explained above, in the golf club shaft of the present invention, consideration is given to the distributions of flexural rigidity, crush rigidity and torsional rigidity. Therefore, the golf club shaft of the present invention is provided with various required characteristics by which the user can be satisfied.

What is claimed is:

1. A golf club constructed by a pipe-shaped body in which a sheet of reinforced fiber prepeg impregnated with synthetic resin is rolled, comprising: a front end portion to which a club head is attached; and a grip portion arranged on the opposite side to the front end portion, wherein a sharply-changed flexural rigidity portion is arranged in the pipe-shaped body between a midpoint of said piped shaped body and a front end portion side of the grip portion, and a maximum flexural rigidity of the sharply-changed flexural rigidity portion is approximate to a maximum flexural rigidity of the grip portion, wherein the grip portion includes a low rigidity portion having a rigidity lower than said maximum flexural rigidity of said sharply-changed flexural rigidity portion by no more than $2\times10^6$ kgf*mm$^2$ and wherein said low rigidity portion contains the lowest rigidity of said grip portion have been added.

* * * * *